US005501015A

United States Patent [19]

Harvey

[11] Patent Number: 5,501,015

[45] Date of Patent: Mar. 26, 1996

[54] HAND-HELD INSTRUMENT FOR CUTTING PAPER OR SIMILAR PLANAR SHEET MATERIAL

[76] Inventor: Edward H. Harvey, 3 Church-End Cottages, Bletchingdon, Oxford, United Kingdom

[21] Appl. No.: 423,026

[22] Filed: Apr. 17, 1995

[30] Foreign Application Priority Data

May 18, 1994 [GB] United Kingdom ..... 94099363

[51] Int. Cl.[6] ..... B26B 3/08

[52] U.S. Cl. ..... 30/164.9; 30/317

[58] Field of Search ..... 30/164.9, 317, 30/320, 321, 314, 337

[56] References Cited

U.S. PATENT DOCUMENTS

| | | | |
|---|---|---|---|
| 2,659,143 | 11/1953 | Baker | 30/317 |
| 2,805,475 | 9/1957 | Adams | 30/320 |
| 3,080,653 | 3/1963 | Dolin | 30/317 |
| 3,886,656 | 6/1975 | Meshulam et al. | 30/164.9 |
| 4,010,542 | 3/1977 | Richardson et al. | 30/317 |
| 4,205,438 | 6/1980 | Sikorski | 30/164.9 |
| 4,344,230 | 8/1982 | Olander | 30/317 |

FOREIGN PATENT DOCUMENTS 1487710 3/1976 United Kingdom .

*Primary Examiner*—Hwei-Siu Payer
*Attorney, Agent, or Firm*—Edward A. Sokolski

[57] ABSTRACT

An instrument for cutting paper or similar planar sheet material is provided which comprises a cutter blade mounted in a head portion for rotation about an axis, an elongate handle portion and a neck portion connecting the head portion to the handle portion.

The handle portion extends at an acute angle with respect to the axis of rotation of the cutter blade whereby, when the instrument is in its position of use with the cutter blade in contact with a sheet to be cut and the axis of rotation of the cutter blade substantially vertical, the axis of rotation of the cutter blade and the longitudinal axis of the handle portion, when extended, intersect at a point on the opposite side of the planar sheet from the cutter blade and spaced therefrom.

The cutter blade has a cutting edge terminating in a cutting tip, the cutting edge extending at an angle to the planar sheet to be cut when the instrument is in its position of use whereby the cutting tip will trail behind the rotational axis of the cutter blade when the instrument is moved to cut the planar sheet.

15 Claims, 2 Drawing Sheets

HAND-HELD INSTRUMENT FOR CUTTING PAPER OR SIMILAR PLANAR SHEET MATERIAL

FIELD OF THE INVENTION

This invention relates to a hand-held instrument for cutting paper, film or similar planar sheet material.

1. Background of the Invention

A problem commonly encountered when cutting paper, particularly when cutting curves, arcs, circles, zigzags or the like in paper, using a conventional craft knife is that due to the difficulty of keeping the blade of the knife properly aligned with the line of cut the paper tends to buckle or distort as cutting proceeds, making it difficult to obtain a clean and accurate cut.

2. Prior Art

In an attempt to overcome the aforesaid problem a hand-held cutting instrument has been proposed which comprises an elongate handle portion, a shaft coaxial with the longitudinal axis of the handle portion, the shaft being rotatably mounted in and extending from one end of the handle portion, and a cutting blade integral with said shaft and which, when the instrument is in its position of use, extends outwardly and downwardly from the shaft and terminates in a cutting tip. The instrument is held in the hand in the manner of a pen and is used to cut paper by placing the cutting tip firmly in contact with a sheet of paper to be cut and moving the handle portion, and hence the tip, in the direction of the desired cut, the idea being that during cutting the cutting tip trails behind the handle portion so that the cutting blade is always properly aligned with the line of cut. A disadvantage with this proposal is that in order to ensure that the cutting tip properly trails behind the handle portion it is necessary that the distance by which the cutting tip trails behind the common axis of the handle portion and shaft is relatively long, i.e., is in excess of 5 mm. This, combined with the fact that the handle portion and said shaft share a common axis, makes the cutting instrument unstable and difficult to control, particularly when cutting small curves or arcs.

In British Patent Specification No. 1,487,710 there is disclosed a cutting instrument for cutting paper, film or similar sheet materials. The instrument disclosed comprises a blade releasably secured to one end of a rod which is rotatably carried by, and extends axially within, a hollow blade holder which is itself pivotally mounted to one end of an elongate handle, yet can be secured at a desired position about its pivot axis which extends transversely to the longitudinal axis of the elongate handle. The instrument comprises means for releasably securing the rod against rotation relative to the blade holder and means for facilitating rotation by hand of the rod relative to the blade holder—one hand of the user carrying the instrument while the other hand adjusts the rotation of the blade. This proposal suffers from the disadvantage that it is specifically designed for two-handed operation and requires a high degree of skill and coordination if it is to be used effectively.

OBJECT OF THE INVENTION

It is an object of the present invention to provide a hand-held instrument for cutting paper, film or similar planar sheet material which is an improvement on and overcomes the disadvantages of said prior art proposals.

SUMMARY OF THE INVENTION

The present invention provides a hand-held instrument for cutting paper, film or similar planar sheet material, comprising:

(a) a cutter blade freely rotatable about an axis, (b) an elongate handle portion offset from and extending at a permanently fixed acute angle with respect to the axis of rotation of the cutter blade, (c) the instrument having a position of use in which the cutter blade is in contact with the upper surface of a horizontal planar sheet to be cut, the axis of rotation of the cutter blade is substantially vertical and the handle portion can be held in the hand in the manner of a pen, (d) the axis of rotation of the cutter blade and the longitudinal axis of the handle portion, if said axes are extended, intersecting at a point below the lower surface of said horizontal planar sheet when the instrument is in said position of use, (e) the cutter blade having a cutting edge which extends at an acute angle to said horizontal planar sheet when the instrument is in said position of use, and (f) the cutting edge of the cutter blade terminating in a cutting tip which first contacts the planar sheet to be cut and which, when by manipulation of the handle portion the cutting blade is moved to cut the planar sheet, trails behind the rotational axis of the cutter blade to properly align the cutter blade with the direction of cut.

The distance by which the cutting tip of the cutting edge trails behind the axis of rotation of the cutter blade may be from 1 to 5 mm., preferably 1.5 mm. Because this amount of trail is small it is essential that the cutter blade is freely rotatable and to this end the cutter blade may be mounted for rotation in low-friction bearing means, preferably ball or roller bearing means.

At least the cutting edge of the cutter blade may be formed from tungsten carbide or a suitable ceramic or other wear resistant material.

The longitudinal axis of the handle portion may extend at an angle of from 30 to 50 degrees, preferably 40 degrees, with respect to the axis of rotation of the cutter blade.

The instrument according to the present invention may comprise a head portion containing bearing means for said cutter blade and a neck portion extending substantially radially outwardly of the head portion and connecting the head portion to the handle portion. Said head, neck and handle portions may be integrally moulded from synthetic plastics material.

DETAILED DESCRIPTION OF THE DRAWINGS

Figure 1:
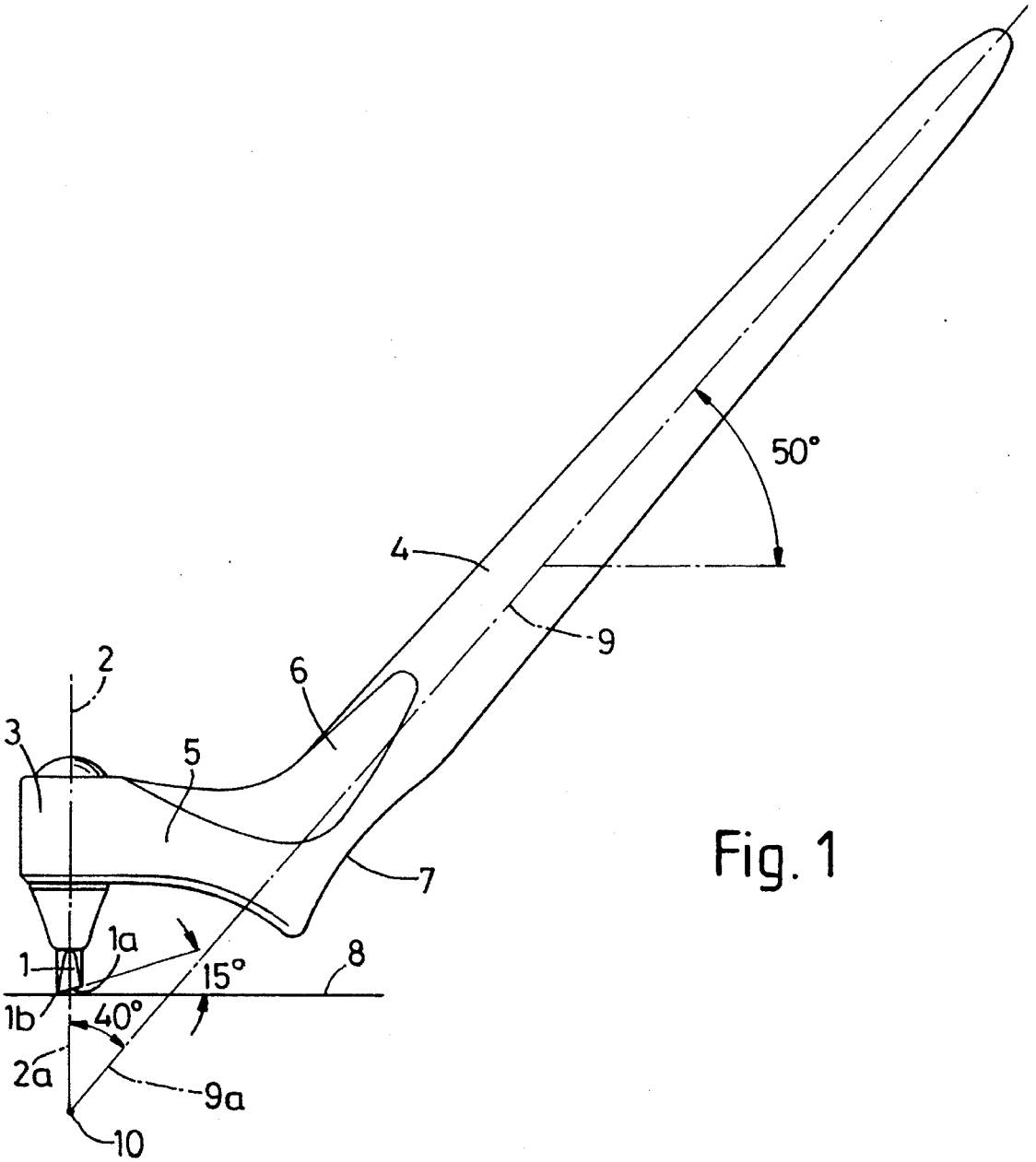
FIG. 1 is a side elevation of a preferred embodiment of a hand-held instrument for cutting paper, film or similar planar sheet material according to the present invention.

Referring to FIG. 1 it will be seen that the embodiment illustrated comprises a cutter blade 1 mounted for rotation about an axis 2 in a head portion 3, an elongate handle portion 4 and a neck portion 5 extending substantially radially outwardly of the head portion 3 and connecting the head portion 3 to the handle portion 4. Head portion 3, neck portion 5 and handle portion 4 are integrally formed as by moulding from synthetic plastics material.

Handle portion 4 is intended to be held in the hand in the manner of a pen and to facilitate this and provide improved comfort and control the handle portion 4 and neck portion 5 are provided with opposed thumb and finger supports 6 (only one of which is shown) and with a waisted portion 7.

The embodiment is shown in FIG. 1 in a preferred position of use with the cutter blade 1 in contact with the upper surface of a horizontal planar sheet 8 and with the rotational axis 2 of the cutter blade 1 substantially vertical. As will be apparent from the drawing, handle portion 4 is offset from and extends at an acute angle with respect to the rotational axis 2 of cutter blade 1, whereby when the rotational axis 2 of cutter blade 1 and the longitudinal axis 9 of handle portion 4 are extended as shown at 2*a*, 9*a*, they intersect at a point 10 below the lower surface of planar sheet 8.

The angle between the axes 2 and 9 is 40 degrees in the embodiment illustrated, although this angle may be varied if desired and may, for example, be anything from 30 to 50 degrees.

When the embodiment is in the position of use shown in FIG. 1, the cutting edge 1*a* of cutter blade 1 extends at an angle with respect to planar sheet 8 whereby the tip 1*b* of the cutting edge 1*a* in contact with the planar sheet 8 will trail behind the axis of rotation 2 of the cutter blade 1 as the cutter blade 1 is moved to cut the planar sheet 8. The angle between the cutting edge 1*a* of the cutter blade 1 and the planar sheet 8 may be from 10 to 20 degrees, preferably 15 degrees, whilst the distance between the rotational axis 2 of cutter blade 1 and the tip 1*b* of cutting edge 1*a*, i.e. the length of said trail, may be from 1 to 5 mm., preferably 1.5 mm.

As shown in FIG. 1, the angle between the longitudinal axis 9 of the handle portion 4 and the plane of the paper 8 is preferably 50 degrees.

Because of the abrasive nature of paper, cutter blade 1 is preferably formed from tungsten carbide or other hard wear resistant material such as a suitable ceramic material, although it could be formed from steel or other suitable material or could simply have the cutting edge 1*a* thereof formed from or coated with a hard wear resistant material such as tungsten carbide or a suitable ceramics material.

Figure 2:
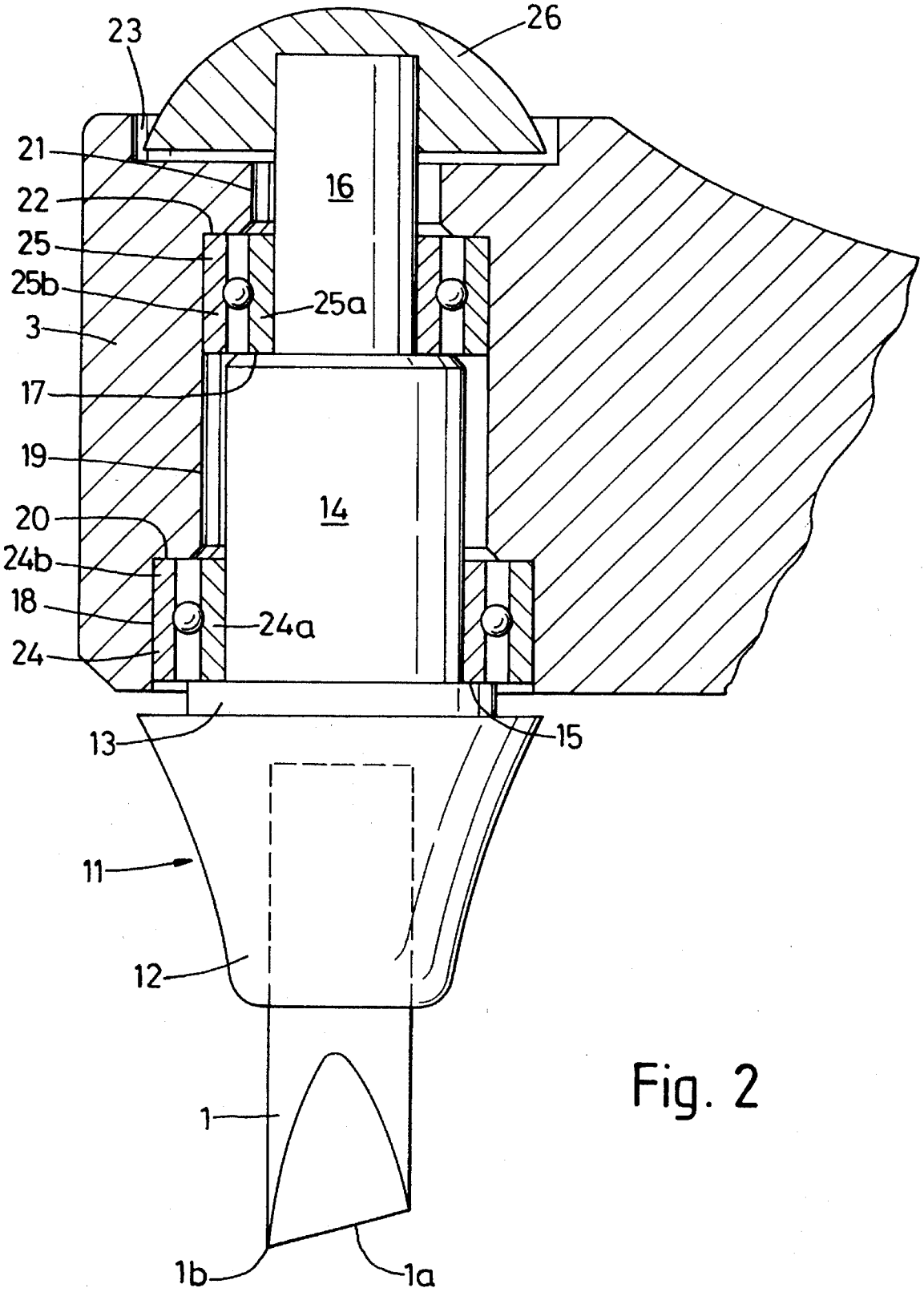
FIG. 2 is an enlarged sectional fragmentary view of a head portion of the instrument of FIG. 1.

Referring now to FIG. 2 it will be seen that the cutter blade 1 is firmly mounted in a carrier 11 having a circular section body portion 12 which, in the aspect of the drawing, flares upwardly and outwardly from the exposed portion of the cutter blade 1, a bearing support 13 of smaller diameter than the upper end of the body portion 12, a shaft portion 14 of smaller diameter than and extending upwardly from the bearing support 13 to define a shoulder 15 and a spigot portion 16 of smaller diameter than and extending upwardly from the shaft portion 14 to define a shoulder 17.

Head portion 3 has a circular passage extending therethrough comprising a first section 18, a second section 19 of smaller diameter than the section 18 and defining therewith a shoulder 20, a third section 21 of smaller diameter than the section 19 and defining therewith a shoulder 22 and an open-ended recess section 23 of larger diameter than the section 21.

Mounted within the head portion 3 and supporting the carrier 11, and hence the cutter blade 1, for rotary movement are ball-bearings 24,25. The inner race 24*a* of ball bearing 24 is fast with shaft portion 14 and is located on shoulder 15 whilst the outer race 24*b* is fast with passage section 18 and is located on shoulder 20. The inner race 25*a* of ball bearing 25 is fast with spigot portion 16 and is located on shoulder 17 whilst the outer race 25*b* is fast with passage section 19 and is located on shoulder 20. A retaining cap 26 fast with spigot portion 16 and partially housed in recess 23 maintains the assembly of the carrier 11 and bearings 24,25 with the head portion 3.

Because the distance between the axis 2 of cutter blade 1 and the tip 1*b* of cutting edge 1*a* is only 1.5 mm. in the illustrated embodiment and because the axes 2 and 9 of cutter blade 1 and handle portion 4, when extended, intersect at point 10 well below the lower surface of planar sheet 8, the triangle of forces which comes into effect when the embodiment is in use provides the embodiment with good lateral stability, e.g. when moved towards the right or left of the user, making the embodiment very stable and easy to control and enabling even relatively small curves, arcs, zigzags or the like to be cut in paper with ease and without any buckling or distortion of the paper. The short length of the cutting edge 1*a*, which in the illustrated embodiment is only 3 mm., reduces friction with the sheet 8 during cutting to a minimum whilst the angle of the longitudinal axis 9 of handle portion 4 relative to the axis of rotation 2 of the cutter blade 1 ensures that, in use, the instrument can be held comfortably in one hand in the manner of a pen, and in what would if the instrument were a pen be a comfortable writing position, whilst maintaining the axis of rotation 2 of the cutter blade 1 substantially vertical.

I claim:

1. A hand-held instrument for cutting planar sheet material in a predetermined direction of cut, comprising:

(a) a cutter blade at least the cutting edge of which is formed from a hard wear resistant material, (b) a head portion containing ball or roller bearing means in which said cutter blade is mounted so as to be freely rotatable about an axis, (c) a neck portion integral with the head portion and extending substantially radially outwardly thereof, (d) an elongate handle portion integral with the neck portion, the longitudinal axis of the handle portion extending at an angle of from 30 to 50 degrees with respect to the axis of rotation of the cutter blade, (e) the instrument having a position of use in which the cutter blade is in contact with the upper surface of a horizontal planar sheet to be cut, the axis of rotation of the cutter blade is substantially vertical and the handle portion can be held in the manner of a pen, (f) the axis of rotation of the cutter blade and the longitudinal axis of the handle portion, if said axes are extended, intersecting at a point below the lower surface of said horizontal planar sheet when the instrument is in said position of use, (g) the cutter blade having a cutting edge which extends at an angle of from 10 to 20 degrees to said horizontal planar sheet when the instrument is in said position of use, and (h) the cutting edge of the cutter blade terminating in a cutting tip which first contacts the planar sheet to be cut and which, when by manipulation of the handle portion the cutting blade is moved to cut the planer sheet, trails behind the rotational axis of the cutter blade by a distance of from 1 to 5 mm to properly align the cutter blade with the direction of cut.

2. An instrument according to claim 1, wherein the longitudinal axis of the handle portion extends at an angle of 40 degrees with respect to the axis of rotation of the cutter blade.

3. An instrument according to claim 1, wherein the distance by which the cutting tip of the cutting edge trails behind the axis of rotation of the cutter blade when the instrument is in use is 1.5 mm.

4. An instrument according to claim 1, wherein the angle between the cutting edge of the cutter blade and said planer sheet when the instrument is in said position of use is 15 degrees.

5. A hand-held instrument for cutting planar sheet material in a predetermined direction of cut, comprising:

(a) a cutter blade freely rotatable about an axis, (b) an elongate handle portion offset from and extending at a permanently fixed acute angle with respect to the axis of rotation of the cutter blade, (c) the instrument having a position of use in which the cutter blade is in contact with the upper surface of a horizontal planar sheet to be cut, the axis of rotation of the cutter blade is substantially vertical and the handle portion can be held in the manner of a pen, (d) the axis of rotation of the cutter blade and the longitudinal axis of the handle portion, if said axes are extended, intersecting at a point below the lower surface of said horizontal planar sheet when the instrument is in said position of use, (e) the cutter blade having a cutting edge which extends at an acute angle to said horizontal planar sheet when the instrument is in said position of use, and (f) the cutting edge of the cutter blade terminating in a cutting tip which first contacts the planar sheet to be cut and which, when by manipulation of the handle portion the cutting blade is moved to cut the planar sheet, trails behind the rotational axis of the cutter blade to properly align the cutter blade with the direction of cut.

6. An instrument according to claim 5, wherein the distance by which the cutting tip of the cutting edge trails behind the axis of rotation of the cutter blade is from 1 to 5 mm.

7. An instrument according to claim 6, wherein said distance is 1.5 mm.

8. An instrument according to claim 5, wherein at least the cutting edge of the cutter blade is formed from tungsten carbide.

9. An instrument according to claim 5, wherein the cutter blade is mounted for rotation in ball or roller bearing means.

10. An instrument according to claim 5, wherein the longitudinal axis of the handle portion extends at an angle of from 30 to 50 degrees with respect to the axis of rotation of the cutter blade.

11. An instrument according to claim 10, wherein the longitudinal axis of the handle portion extends at an angle of 40 degrees with respect to the axis of rotation of the cutter blade.

12. An instrument according to claim 5, wherein the angle between the cutting edge of the cutter blade and said planar sheet when the instrument is in said position of use is from 10 to 20 degrees.

13. An instrument according to claim 12, wherein said angle is 15 degrees.

14. An instrument according to claim 5, comprising a head portion containing bearing means for said cutter blade and a neck portion extending substantially radially outwardly of the head portion and connecting the head portion to the handle portion.

15. An instrument according to claim 14, wherein said head, neck and handle portions are integrally moulded from synthetic plastics material.

* * * * *